US011882915B2

(12) United States Patent
Zheng et al.

(10) Patent No.: US 11,882,915 B2
(45) Date of Patent: Jan. 30, 2024

(54) REFILLABLE CONTAINER

(71) Applicant: APR Beauty Group Inc., Toronto (CA)

(72) Inventors: Min-Yan Zheng, Richmond Hill (CA); Feng-Ying Fu, Markham (CA)

(73) Assignee: APR BEAUTY GROUP INC., Toronto (CA)

( * ) Notice: Subject to any disclaimer, the term of this patent is extended or adjusted under 35 U.S.C. 154(b) by 798 days.

(21) Appl. No.: 17/000,027

(22) Filed: Aug. 21, 2020

(65) Prior Publication Data

US 2022/0053913 A1 Feb. 24, 2022

(51) Int. Cl.
*A45D 40/06* (2006.01)
*A45D 40/00* (2006.01)

(52) U.S. Cl.
CPC ..... *A45D 40/06* (2013.01); *A45D 2040/005* (2013.01); *A45D 2040/0037* (2013.01)

(58) Field of Classification Search
CPC .... A45D 40/02; A45D 40/023; A45D 40/026; A45D 40/04; A45D 40/06; A45D 40/065; A45D 2040/0037; A45D 2040/005
USPC ..... 132/318, 317, 218, 297, 320; 401/53; 206/385
See application file for complete search history.

(56) References Cited

U.S. PATENT DOCUMENTS

| | | | | |
|---|---|---|---|---|
| 3,002,611 | A * | 10/1961 | Doblin | A45D 40/06 401/86 |
| 2009/0097899 | A1* | 4/2009 | Carroll | A45D 40/02 401/109 |
| 2015/0110539 | A1* | 4/2015 | Huang | A45D 40/16 401/86 |
| 2017/0049211 | A1* | 2/2017 | Liard | A45D 40/04 |
| 2019/0246769 | A1* | 8/2019 | Genelot | A45D 40/205 |

* cited by examiner

*Primary Examiner* — King M Chu

(57) ABSTRACT

A refillable container for a stick type cosmetic product comprising a cap, a refill cartridge and a base assembly. The base assembly comprises an outer shell, a button member, and a limiting member. The refill cartridge is configured to be detachably received at least partially within a cavity of the outer shell of the base assembly such that the refill cartridge may be removed and replaced from said base assembly by pressing the button member provided in the base assembly.

20 Claims, 7 Drawing Sheets

REFILLABLE CONTAINER

BACKGROUND

Field of the Invention

The present disclosure relates generally to a refillable container for a stick type cosmetic product.

Description of the Related Art

Stick type cosmetic products such as lipstick for adding color, texture, and protection to the skin has been available in cylindrical metal tubes since 1915.

A user conventionally must buy a stick dispensing container with the stick product, such as for example lipstick, adding significant cost. Since the cost of the lipstick product and dispenser combination is relatively high, a manufacturer may limit the number of lipstick types or lipstick colors to be offered, to avoid an overstock of relatively expensive dispensers containing less popular lipstick colors or shade variations.

Refill containers for consumer products are considered environmental friendly in a way that lesser material is utilized in their manufacturing. These are also economical for the consumers as well as manufacturers. The consumers don't have to spend the same amount of money for the refills while for manufacturers they enable lower consumption of inputs such as raw materials and energy. Various attempts have been made to refine make-up packages such as compacts, lipsticks, etc. to provide an option of refilling the product.

The known refill containers for cosmetic products generally comprise of a refillable container that houses the product which may or may not have a propelling/dispensing mechanism therefore and such refills are then replaced into the refillable container once the product is used by the user. For example, there are available stick product packages which are refillable where a refill cartridge is replaced once the stick is used up by the user.

Most of the refillable packages are available for stick consumer products. For example, U.S. Pat. No. 4,505,607 to Sugiyama discloses a retractable-type cosmetic container that includes a holder having a cosmetic projecting-retracting means and adapted to be mounted on a manipulating member provided separately from the holder, and a cap closure. An inner tube of the holder is provided at its lower end with an opening of angular shape within which a hollow projection of the manipulating member is detachably engaged for unitary rotation of the member and the inner tube.

Similarly U.S. Pat. No. 5,399,040 to Holloway discloses a refill cartridge comprising a cosmetic holder including a tubular inner body, a tubular cam sleeve covering tubular inner body, and an elevator cup within inner body and a retaining means is provided to hold the refill and the base member together.

There is still a need for an improved refillable container in which removal and attachment of the refill is simple and easy.

SUMMARY

Accordingly, there is provided a refillable container for a stick type cosmetic product comprising a cap, a refill cartridge and a base assembly. The cap is detachably attached to the base assembly. The refill cartridge is configured to be detachably received at least partially within a cavity of the outer shell of the base assembly such that the refill cartridge can be replaced when a stick type cosmetic product held within the refill cartridge is used up by a consumer. The base assembly and the cap are thus retained for re-use, while the refill cartridge can be replaced with a new refill cartridge. The refill cartridge may be removed and replaced from said base assembly by pressing a button member provided in the base assembly.

According to an aspect of the present disclosure, the base assembly comprises an outer shell, the button member, a limiting member, a sliding member and a spring. The outer shell is a body with a sidewall, a bottom wall, an opening at its distal end, and defining the cavity to receive the refill cartridge therein.

According to an aspect of the present disclosure, the outer shell of the base assembly includes features on its outer surface to detachably connect to the cap. In a preferred embodiment, the outer shell comprises at least one bead on its outer surface and the cap includes a corresponding groove at its inner surface for snap fitment. In alternative embodiments, the cap and the outer shell of the base assembly may be removably secured to each other by any other method known in the art.

According to another aspect of the present disclosure, the refill cartridge includes an inner sleeve, a spiral cam sleeve, a carrier cup and an outer sleeve. The inner sleeve comprises an upper cylindrical portion having a cylindrical sidewall, an open top end, a closed bottom wall, and at least one longitudinal slot in the cylindrical sidewall thereof. Further, a tubular projection extends downwardly from an outer surface of the closed bottom wall of the upper cylindrical portion of the inner sleeve. The tubular projection of the inner sleeve comprises a cylindrical distal portion, a cylindrical rim portion and a conical portion. The conical portion is stepped in from the cylindrical rim portion and extends between the cylindrical distal portion and the cylindrical rim portion. The spiral cam sleeve surrounds the upper cylindrical portion of the inner sleeve and is provided with a spiral groove extending throughout the length of said spiral cam sleeve on an inner surface of the spiral cam sleeve. The carrier cup has an actuating pin projecting laterally from an outer surface of said carrier cup. The carrier cup is slidably movable inside said inner sleeve and wherein the actuating pin projects through the longitudinal slot of the inner sleeve engages with said spiral slot of the spiral cam sleeve, whereby turning movement of the inner sleeve relative to the spiral cam sleeve propels the carrier cup towards the open end of the inner sleeve or retract it therefrom. The outer sleeve is tightly surrounding the spiral cam sleeve and holding it in radially compressed condition whereby relative turning movement between the outer sleeve and the spiral cam sleeve is prevented.

After the refill cartridge is assembled with the base assembly, a user holds the outer sleeve, and rotates the outer shell of the base assembly, causing rotation of the inner sleeve, while the spiral cam sleeve remains static. As a result, the actuating pin of the carrier cup moves in the spiral groove of the spiral cam sleeve, driving the carrier cup to move up or down in the inner sleeve.

More particularly, during use, the user rotates the outer shell of the base assembly in a first direction, the carrier cup in an upward direction to expose the cosmetic product in the carrier cup from the opening at the distal end of the inner sleeve.

After use, the user rotates the outer shell in a second direction opposite to the first direction, which causes the carrier cup to move in a downward direction to hide the cosmetic product in the inner sleeve.

In alternate embodiments, other types of retractable operators may be used in place of the cam and slot arrangement which is explained in the present disclosure, such as vertical slide type or push type or any other mechanism known in the art.

According to yet another aspect of the present disclosure, the outer shell of the base assembly comprises at least one sidewall and the bottom wall. An aperture for receiving a portion of the button member is formed in the outer shell at one sidewall. An inner surface of the sidewall of the outer shell comprises an inner step near a distal end portion of the outer shell. A rotation lock portion is provided on the inner surface of the sidewall of the outer shell located above the inner step, and wherein the rotation lock portion comprises a plurality of first ribs, which is evenly distributed in a circumferential direction on the inner surface of the sidewall of the outer shell. Further, an annular cylindrical outer surface which is stepped out from a lower portion of the cylindrical sidewall of the inner sleeve comprises a plurality of second ribs which are evenly distributed in a circumferential direction. The plurality of first ribs of the outer shell engages with the plurality of second ribs of the inner sleeve to prevent the inner sleeve from rotation relative to the outer shell of the base assembly.

According to yet another aspect of the present disclosure, the outer shell of the base assembly is configured to receive the tubular projection of the inner sleeve of the refill cartridge within the cavity of the outer shell below the inner step of the outer shell, while the upper cylindrical portion of the inner sleeve is received within the cavity of the outer shell above the inner step such that the bottom wall of the upper cylindrical portion of the inner sleeve rests on the inner step of the outer shell.

According to yet another aspect of the present disclosure, the button member comprises a button portion and a gripping portion. The gripping portion comprises a pair of arcuate portions opposite to each other in a circumferential direction. When assembled to the outer shell of the base assembly, the button portion is exposed to an outer side through the aperture formed in the sidewall of the outer shell of the base assembly, while the pair of arcuate portions lies within the cavity of the outer shell. The pair of arcuate portions of the button member is elastically deformable. Further, a first end of each of the arcuate portions is connected to an inner surface of the button portion, while a second end of each of the arcuate portions is a free end i.e. each of the pair of arcuate portion comprises a free second end. The free second end of each of the arcuate portions faces each other and a circumferential gap exists between the free second ends of the arcuate portions. The pair of arcuate portions of the button member is configured to be detachably fitted around the tubular projection, more particularly, around the conical portion of the tubular projection of the inner sleeve. Furthermore, the pair of arcuate portions of the button member includes at least three grip grooves located near the free second ends of the pair of arcuate portions. More particularly, an outer surface of the first arcuate portion includes a first grip groove near its free second end and an outer surface of the second arcuate portion includes a third grip groove near its free second end. A second grip groove is a discontinuous groove which is partially formed on the first arcuate portion and partially on the second arcuate portion on their respective inner surfaces at the free second end portions, separated by the circumferential gap.

According to yet another aspect of the present disclosure, the sliding member is completely housed inside the outer shell of the base assembly and is slidable within the outer shell. The sliding member comprises a top flat wall and an annular skirt extending downward from a lower surface of the top flat wall of the sliding member. Further, at least one slide groove is formed in the top flat wall of the sliding member at a periphery of the top flat wall of the sliding member. The at least one slide groove of the sliding member is configured to engage a corresponding slide guide protrusion formed on the inner surface at a lower portion of outer shell to guide the sliding member to slide in an axial direction by a predetermined interval within the outer shell of the base assembly.

In a preferred embodiment, the sliding member has four slide grooves and the outer shell comprises corresponding four slide guide protrusions so that stability during a sliding movement may be achieved. However, in various embodiments, the number of slide grooves and slide guide protrusions may be more or less than four.

According to yet another aspect of the present disclosure, the base assembly houses the spring which biases the sliding member in an upward direction and forces the sliding member to slide upward when the spring expands on release of a compression force on it. The spring extends between the inner surface of the bottom wall of the outer shell and the annular skirt of the sliding member.

According to yet another aspect of the present disclosure, base assembly houses the limiting member with the cavity of the outer shell. The limiting member is coupled to the inner surface of the outer shell immediately below the step in the outer shell. The limiting member includes at least a coupling protrusion on an outer surface of the limiting member that snap fits into a corresponding coupling groove provided on the inner surface of the sidewall of the outer shell to secure the limiting member to the outer shell of the base assembly.

According to yet another aspect of the present disclosure, the limiting member has an annular ring like structure, and comprises at least three grip projections namely a first grip projection, a second grip projection and a third grip projection, that extend downwardly from a lower end of the limiting member. The limiting member further includes a concave cut out on the outer surface of the limiting member substantially opposite the at least three grip projections. A first grip projection and a third grip projection flush with the outer surface of the limiting member while the second grip projection flush with an inner surface of the limiting member. The limiting member further includes a positioning groove that extends in axially on the outer surface of the limiting member opposite the second grip projection of the limiting member.

According to an aspect of the present disclosure, the limiting member functions to hold the button member in an axially fixed position inside the outer shell of the base assembly. Further, the button member is mounted below the limiting member inside the outer shell of the base assembly. The at least three grip grooves of the pair of arcuate portions of button member are configured to receive the corresponding at least three grip projections of the limiting member to couple the button member to the limiting member, and wherein at least three grip grooves of the pair of arcuate portions of button member have widths into which at least three grip projections of the limiting member fit. More particularly, the first grip projection and a third grip projection of the limiting member are received respectively in the first grip groove and the third grip groove formed on the outer surface of the arcuate portions of the button member.

The second grip projection of the limiting member is received in the second grip groove formed partially on the inner surfaces of the arcuate portions of the button member. Thus, the button member is firmly gripped by the at least three grip projections of the limiting member.

According to yet another aspect of the present disclosure, the inner surface of the sidewall of the outer shell of the base assembly comprises a longitudinal positioning rib that extends from the bottom wall of the outer shell up to the inner step of the outer shell along the sidewall of the outer shell. The positioning longitudinal rib is provided to orient the position of the limiting member within the cavity of the outer shell. Thus, the longitudinal positioning rib engages the positioning groove of the limiting member to orient the limiting member such that the grip projections of the limiting member circumferentially opposes the aperture of the outer shell, and the concave cutout of the limiting member aligns with the aperture of the outer shell. Similarly, the positioning longitudinal rib also orients the button member properly during assembling by engaging between the corresponding gap between the arcuate portions of the button member.

The free second end portions of the arcuate portions of the button member are firmly sandwiched or abut between the second grip projection of the limiting member and the sidewall of the outer shell which increases the installation stability of the button member and also ensures that the button member does not shift axially when the button portion is pressed. In other words, the spring bias the sliding member to slide and push the refill cartridge in an upward discharge position so that the refill cartridge is released from the base assembly.

According to an aspect of the present disclosure, the lower ends of the at least three grip projections of the limiting member define an upper slide limit for the sliding member as it limits further an upward travel movement of the sliding member by abutting the top flat wall of the sliding member. The limiting member thus also prevents the sliding member from getting out of the outer shell by abutting against the top flat wall of the sliding member when the sliding member slides upward.

According to another aspect of the present disclosure, the refill cartridge is inserted into the outer shell of the base assembly preferably through the opening of the outer shell. On inserting the refill cartridge, the tubular projection of the inner sleeve is received in the cavity of the outer shell, and wherein the pair of arcuate portions of the button member pass over the cylindrical rim portion of the tubular projection of the inner sleeve and engage with the conical portion of the tubular projection which is stepped in from the cylindrical rim portion, thereby preventing the refill cartridge from being pulled out from grip of the pair of arcuate portions of the button member. The button portion of the button member acts as a disengaging means attached with the pair of arcuate portions. By pushing in the button portion, the pair of arcuate portions disengages from the tubular projection of the inner sleeve because of elastic deformation of the pair of arcuate portions. In various embodiments, the button portion and the pair of arcuate portions may or may not be integrally attached.

In a rested state, the pair of arcuate portions form a substantially oval or fusiform cross-section with its major axis substantially larger than a diameter of the cylindrical rim portion of the tubular projection of the inner sleeve and its minor axis is smaller than the diameter of the cylindrical rim portion. When the pair of arcuate portions is elastically deformed by pressing the button portion the pair of arcuate portions deform to attain a substantially circular shape, thus an inner diameter formed by the pair of arcuate portions becomes larger than the diameter of the cylindrical rim portion of the tubular projection of the inner sleeve.

The pair of arcuate portions and the button portion may be made of a resilient material such as resilient metal or a hard and elastic synthetic resin. The button portion is slidably received in the radial aperture formed in the at least one sidewall of the outer shell of the base assembly.

In an unstressed state, the pair of arcuate portions engages the conical portion of the tubular projection of the inner sleeve, keeping the refill cartridge from coming off the outer shell of the base assembly. During locking the refill cartridge with the base assembly, a lower end of the refill cartridge moves the sliding member downwardly to compress the spring. When replacing the refill cartridge, the button portion is pushed in by pressing, the pair of arcuate portions, is compressed from both ends of its major axis and deformed into a substantially circular shape having a larger diameter than the diameter of the cylindrical rim portion of the tubular projection of the inner sleeve. In this state, the pair of arcuate portions, disengages from the conical portion of the tubular projection of the inner sleeve. In other words, when the button portion is pressed so that the pair of arcuate portions, is outwardly expanded and elastically deformed, and the pair of arcuate portions is no longer crimped on the conical portion of the tubular projection of the inner sleeve. When the button portion is pressed and the refill cartridge is in a normally removable position, the spring expands causing the sliding member to slide and push the refill cartridge to assume an extended position thereby the refill cartridge is forcefully ejected from the outer shell of the base assembly. The refill cartridge pops out in a vertical direction providing a visual indication to a user that the refill cartridge is now unlocked from the base assembly and thus the refill cartridge may be easily and quickly removed from the base assembly. In other words, the refill cartridge can be removed from the base assembly simply by pushing in the button portion with one finger. Sliding of the sliding member stops in upward direction when it abuts a lower end of the limiting member. A new refill cartridge now can be inserted in the base assembly. Further, when the finger is released from the button portion, the pair of arcuate portions return to their original oval shape by own resiliency restoring to original shapes and are crimped on the conical portion of the new refill cartridge again, thereby fixing the new refill cartridge.

The foregoing description, for purposes of explanation, has been described with reference to specific examples. However, the illustrative discussions above are not intended to be exhaustive or to limit the disclosure to the precise forms disclosed. Many modifications and variations are possible in view of the above teachings. The examples were chosen and described in order to best explain the principles of the disclosure and its practical applications, to thereby enable others skilled in the art to best utilize the disclosure and various examples with various modifications as may be suited to the particular use contemplated.

The above and other objects, features and advantages of the present disclosure will become clear from the following description of the preferred embodiments when the same is read in conjunction with the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings.

Figure 1:
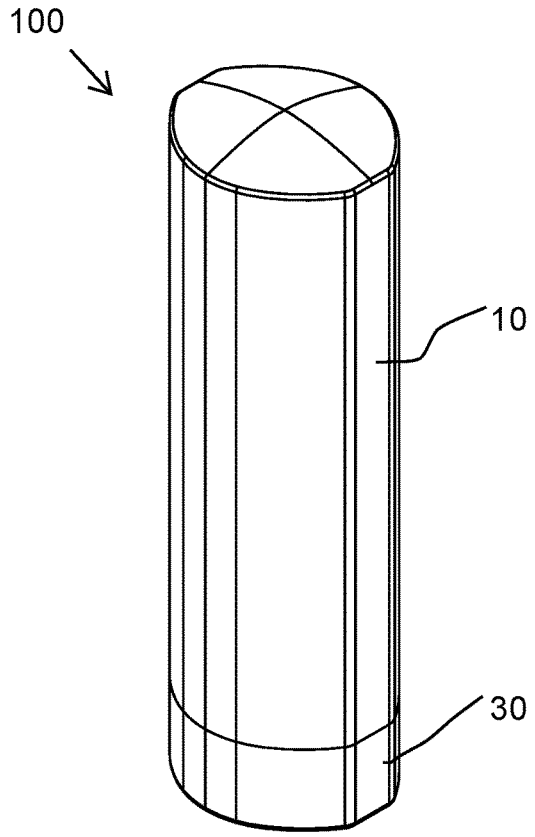
FIG. 1 is a perspective view of a refillable container in a closed state according to an embodiment of the present disclosure.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 2:
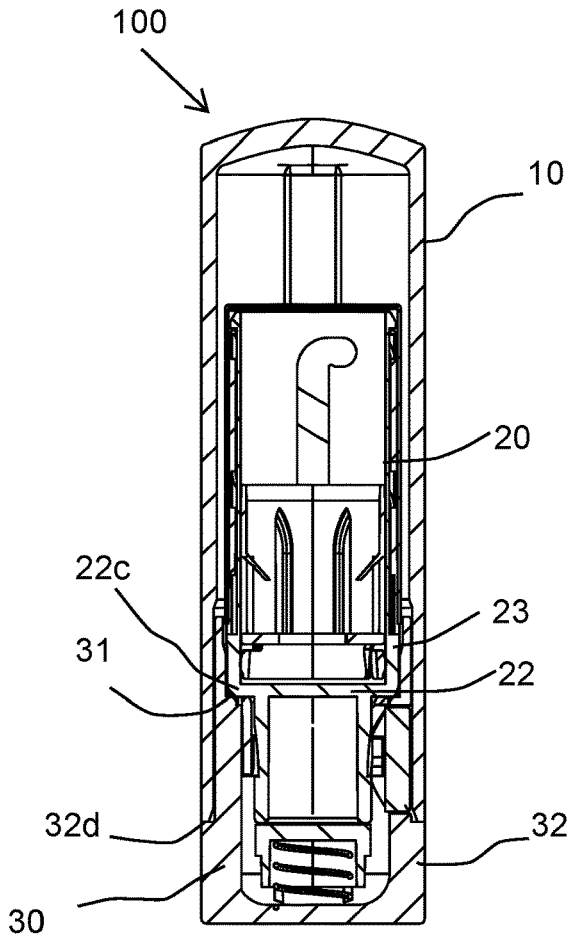
FIG. 2 is a longitudinal cross section of the refillable container of FIG. 1.
Figure 3:
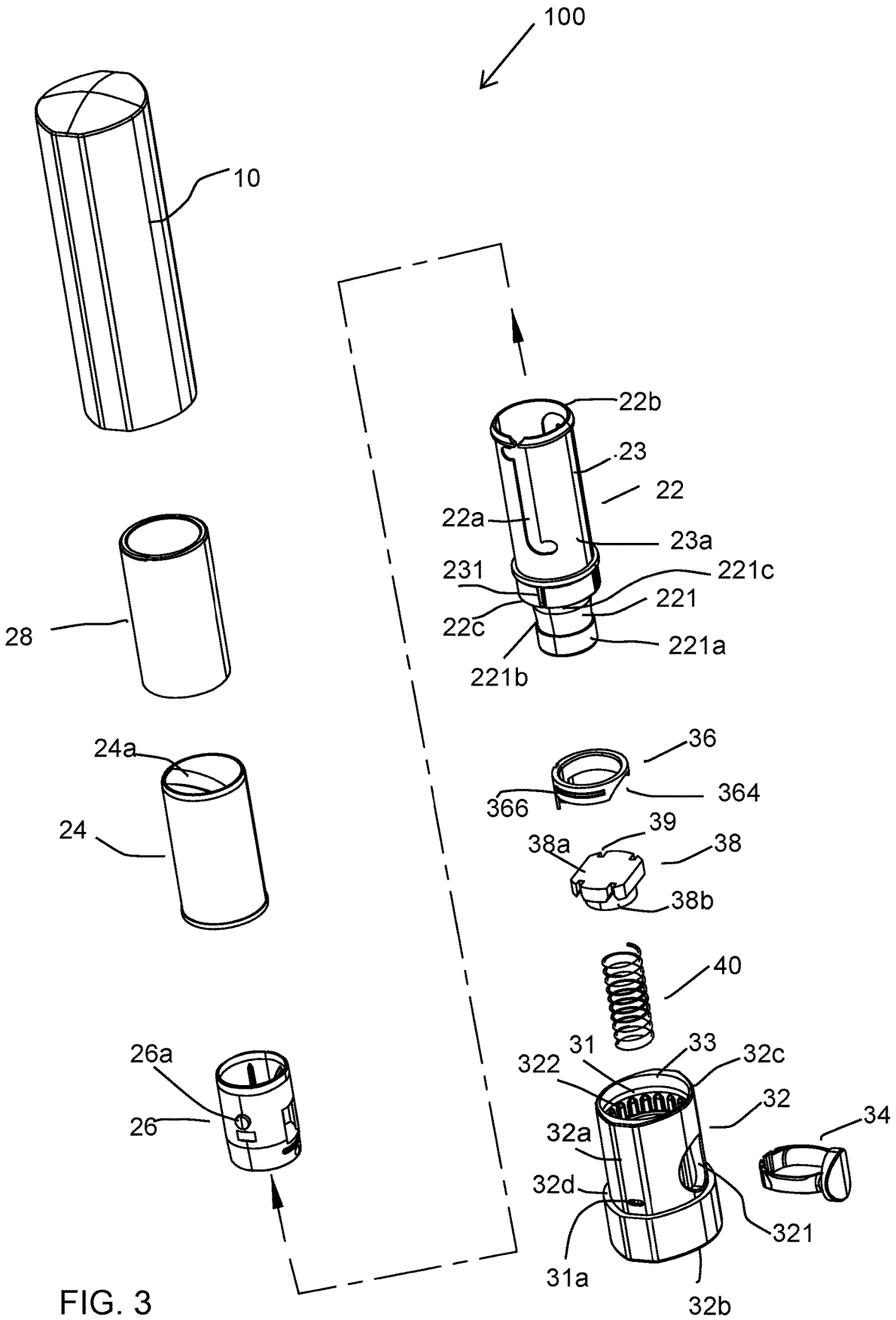
FIG. 3 is an exploded view of the refillable container of FIG. 1.

Referring now more in detail to the drawings, and more particularly to FIGS. 1 to 3 thereof, a refillable container 100 for a stick type cosmetic product (not shown) made in accordance with the present disclosure is shown to include a cap 10, a refill cartridge 20 and a base assembly 30. The stick type cosmetic product includes a solid or semi-solid cosmetic product such as antiperspirant or deodorant stick, lip balm, insect repellent, lipstick, concealer stick, foundation stick etc.

Figure 4:
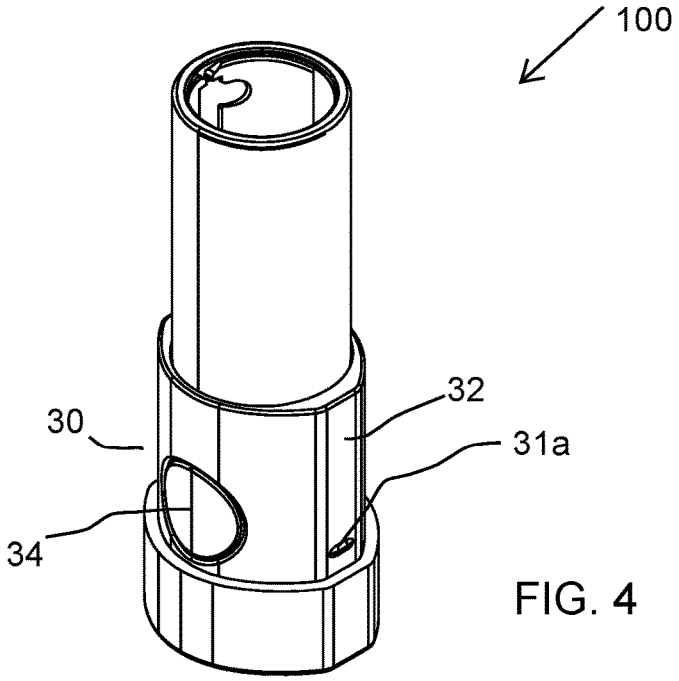
FIG. 4 is a perspective view of the refillable container of FIG. 1 in an open state without a cap.

The cap 10 is detachably attached to the base assembly 30. As seen in FIGS. 3 and 4, an outer shell 32 of the base assembly 30 includes features on its outer surface to detachably connect the cap 10. In the exemplary embodiment, as seen in FIG. 3, the outer shell 32 comprises at least one bead 31*a* on its outer surface and the cap 10 includes a corresponding groove (not visible) at its inner surface for a snap fitment. Further, the outer surface of the outer shell 32 comprises a stepped portion 32*d* and wherein the at least one bead 31*a* is positioned above the stepped portion 32*d*. When the cap 10 is put on the base assembly 20, a lower end of the cap 10 abuts the stepped portion 32*d*, see FIG. 2.

In alternative embodiments, the cap 10 and the outer shell 32 of the base assembly 30 may be removably secured to each other by any other method known in the art.

As shown in FIG. 1, a length of the cap 10 consitutes more than 75% of a length of the refillable container 100. However, in alternate embodiments, the length of the cap 10 may make be greater or less than 75% of the length of the refillable container 100.

As seen in FIGS. 3 and 8-10, the base assembly 30 comprises the outer shell 32, a button member 34, a limiting member 36, a sliding member 38 and a spring 40. The outer shell 32 is a body with a sidewall 32*a*, a bottom wall 32*b*, an opening 32*c* at its distal end, and defining a cavity 33 therein.

Figure 5:
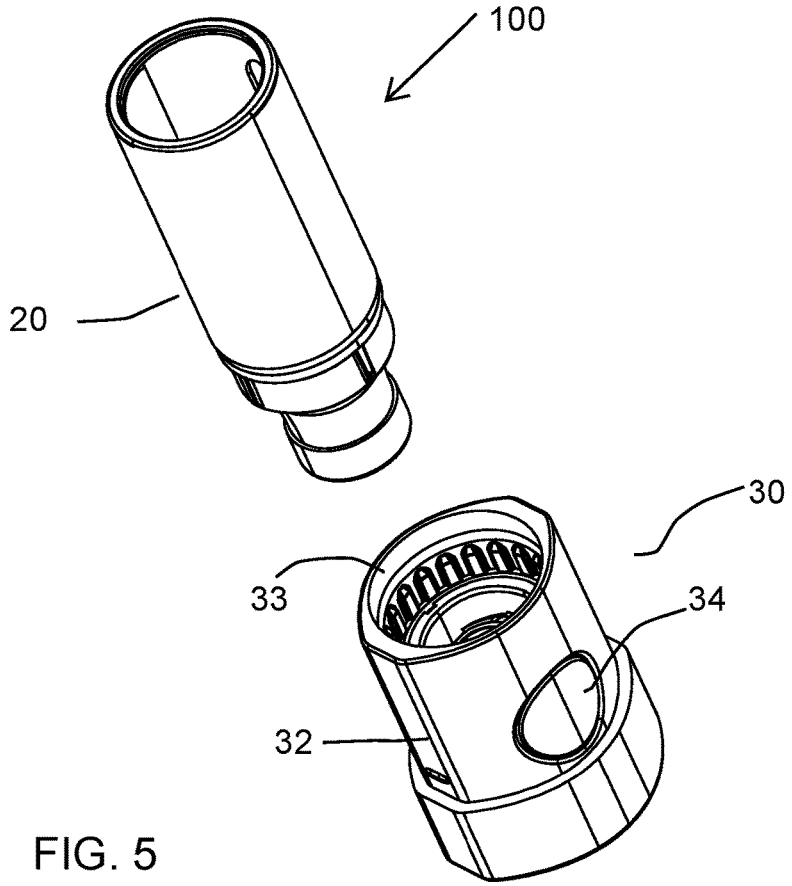
FIG. 5 is a perspective view showing a refill cartridge in a detached state from a base assembly of the refillable container of FIG. 4.

As shown in FIG. 5, the refill cartridge 20 is configured to be detachably received at least partially within the cavity 33 of the outer shell 32 of the base assembly 30 such that the refill cartridge 20 can be replaced when a cosmetic stick (not shown) held within the refill cartridge 20 is used up by a consumer. The base assembly 30 and the cap 10 is thus retained for re-use, while the refill cartridge 20 can be replaced with a new refill cartridge 20. The refill cartridge 20 may be removed and replaced from said base assembly 30 by pressing the button member 34 provided in the base assembly 30. The button member 34 is secured to the outer shell 32 of the base assembly 30.

Figure 6:
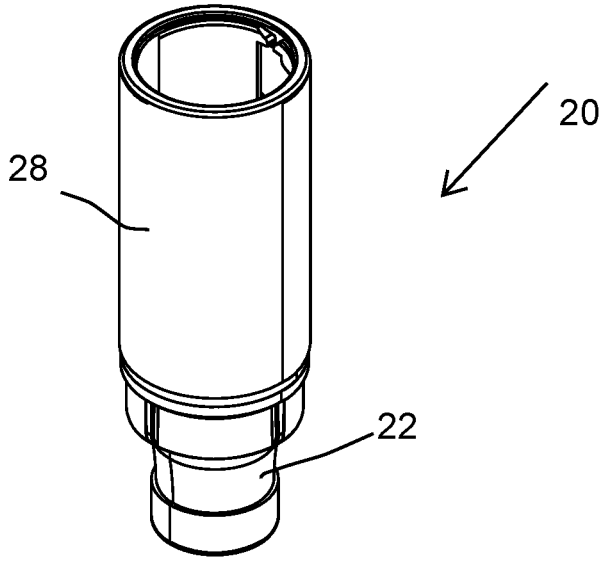
FIG. 6 is a perspective view of the refill cartridge of FIG. 5.
Figure 7:
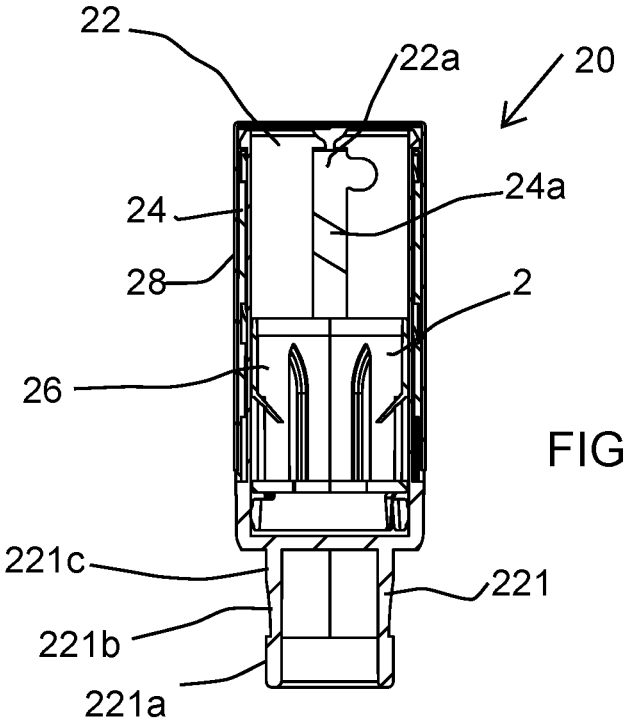
FIG. 7 is a cross sectional view of the refill cartridge of FIG. 6.

Further as shown in FIGS. 3, 6 and 7, the refill cartridge 20 includes an inner sleeve 22, a spiral cam sleeve 24, a carrier cup 26 and an outer sleeve 28. The inner sleeve 22 comprises an upper cylindrical portion 23 having a cylindrical sidewall 23*a*, an open top end 22*b*, a closed bottom wall 22*c*, and at least one longitudinal slot 22*a* in the cylindrical sidewall 23*a* thereof, see FIG. 3. Further, a tubular projection 221 extends downwardly from an outer surface of the closed bottom wall 22*c* of the upper cylindrical portion 23 of the inner sleeve 22. The tubular projection 221 of the inner sleeve 22 comprises a cylindrical distal portion 221*c*, a cylindrical rim portion 221*a* and a conical portion 221*b*. The conical portion 221*b* is stepped in from the cylindrical rim portion 221*a* and extends between the cylindrical distal portion 221*c* and the cylindrical rim portion 221*a*. The spiral cam sleeve 24 surrounds the upper cylindrical portion 23 of said inner sleeve 22 and is provided with a spiral groove 24*a* extending throughout a length of said spiral cam sleeve 24 on an inner surface of the spiral cam sleeve 24. The carrier cup 26 has an actuating pin 26*a* projecting laterally from an outer surface of said carrier cup 26. The carrier cup 26 is slidably movable inside said inner sleeve 22 and wherein the actuating pin 26*a* projects through the longitudinal slot 22*a* of the inner sleeve 22 engages with said spiral slot 24*a* of the spiral cam sleeve 24, whereby turning movement of the inner sleeve 22 relative to the spiral cam sleeve 24 propels the carrier cup 26 towards the open end 22*b* of the inner sleeve 22 or retract it therefrom. The outer sleeve 28 is tightly surrounding the spiral cam sleeve 24 and holding it in radially compressed condition whereby relative turning movement between the outer sleeve 28 and the spiral cam sleeve 24 is prevented.

After the refill cartridge 20 is assembled with the base assembly 30, a user holds the outer sleeve 28, and rotates the outer shell 32 of the base assembly 30, causing rotation of the inner sleeve 22, while the spiral cam sleeve 24 remains static. As a result, the actuating pin 26*a* of the carrier cup 26 moves in the spiral groove 24*a* of the spiral cam sleeve 24, driving the carrier cup 26 to move up or down in the inner sleeve 22.

More particularly, during use, the user rotates the outer shell 32 of the base assembly 30 in a first direction, the carrier cup 26 in an upward direction to expose the cosmetic product in the carrier cup 26 from the opening 22*b* at the distal end of the inner sleeve 22.

After use, the user rotates the outer shell 32 in a second direction opposite to the first direction, which causes the carrier cup 26 to move in a downward direction to hide the cosmetic product in the inner sleeve 22.

In alternate embodiments, other types of retractable operators may be used in place of the cam and slot arrangement which is explained in the present disclosure, such as vertical slide type or push type or any other mechanism known in the art.

Figure 9:
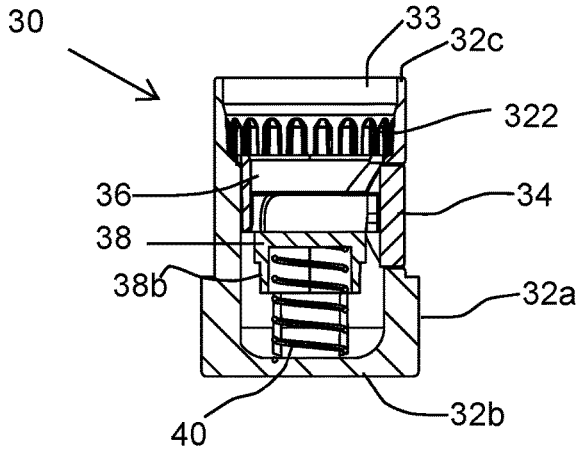
FIG. 9 is a cross-sectional view of the base assembly of FIG. 8.
Figure 10:
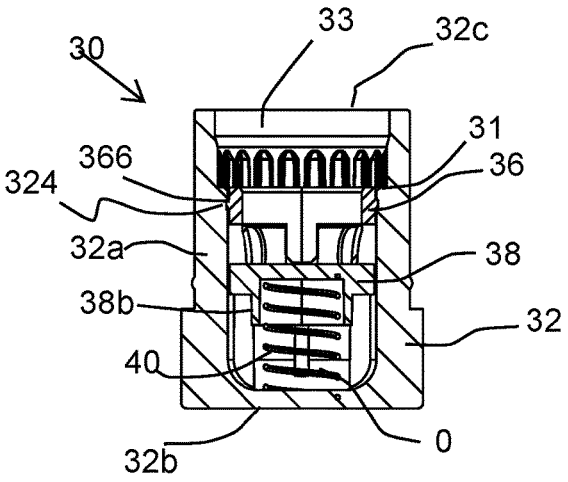
FIG. 10 is another cross-sectional view of the base assembly of FIG. 8.

Referring to FIGS. 3, 9 and 10, the outer shell 32 of the base assembly 30 comprises at least one sidewall 32*a* and the bottom wall 32*b*. An aperture 321 for receiving a portion of the button member 34 is formed in the outer shell 32 at one sidewall 32*a*. An inner surface of the sidewall 32*a* of the outer shell 32 comprises an inner step 31 near a distal end portion of the outer shell 32. A rotation lock portion is provided on the inner surface of the sidewall 32*a* of the outer shell 32 located above the inner step 31, and wherein the rotation lock portion comprises a plurality of first ribs 322, which is evenly distributed in a circumferential direction on the inner surface of the sidewall 32*a* of the outer shell 32. Further, as shown in FIG. 3, an annular cylindrical outer surface which is stepped out from a lower portion of the cylindrical sidewall 23*a* of the inner sleeve 22 comprises a plurality of second ribs 231 which are evenly distributed in a circumferential direction. The plurality of first ribs 322 of the outer shell 32 engages with the plurality of second ribs 231 of the inner sleeve 22 to prevent the inner sleeve 22 from rotation relative to the outer shell 32 of the base assembly 30.

Further, referring to FIG. 2, the outer shell 32 of the base assembly 30 is configured to receive the tubular projection 221 of the inner sleeve 22 of the refill cartridge 20 within the cavity 33 of the outer shell 32 below the inner step 31 of the outer shell 32, while the cylindrical upper portion 23 of the inner sleeve 22 is received within the cavity 33 above the inner step 31 such that the bottom wall 22*c* of the upper cylindrical portion 23 of the inner sleeve 22 rests on the inner step 31 of the outer shell 32.

Figure 8:
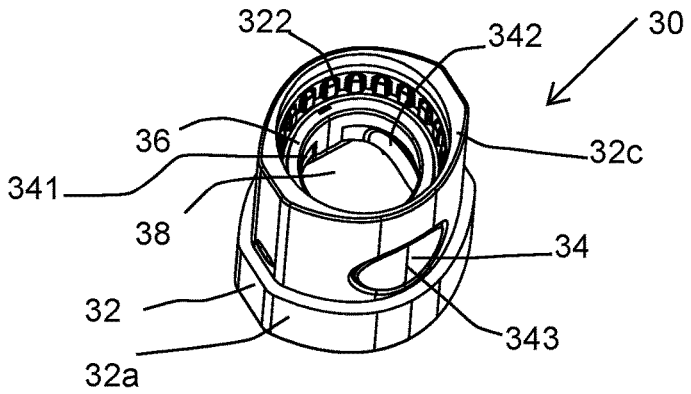
FIG. 8 is a perspective view of the base assembly of FIG. 5.
Figure 12:
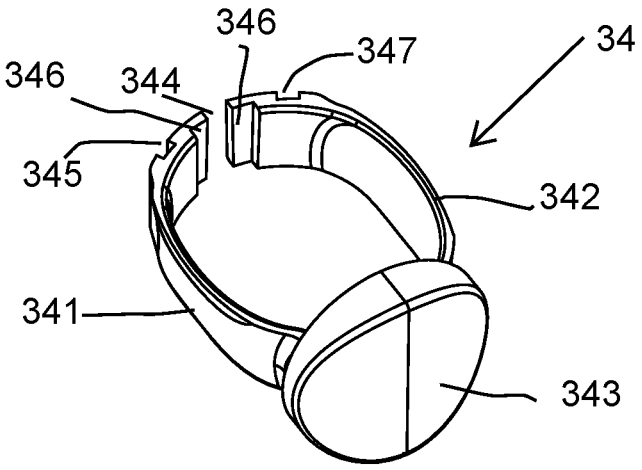
FIG. 12 is a perspective view of a button member of the refillable container of FIG. 3.
Figure 13:
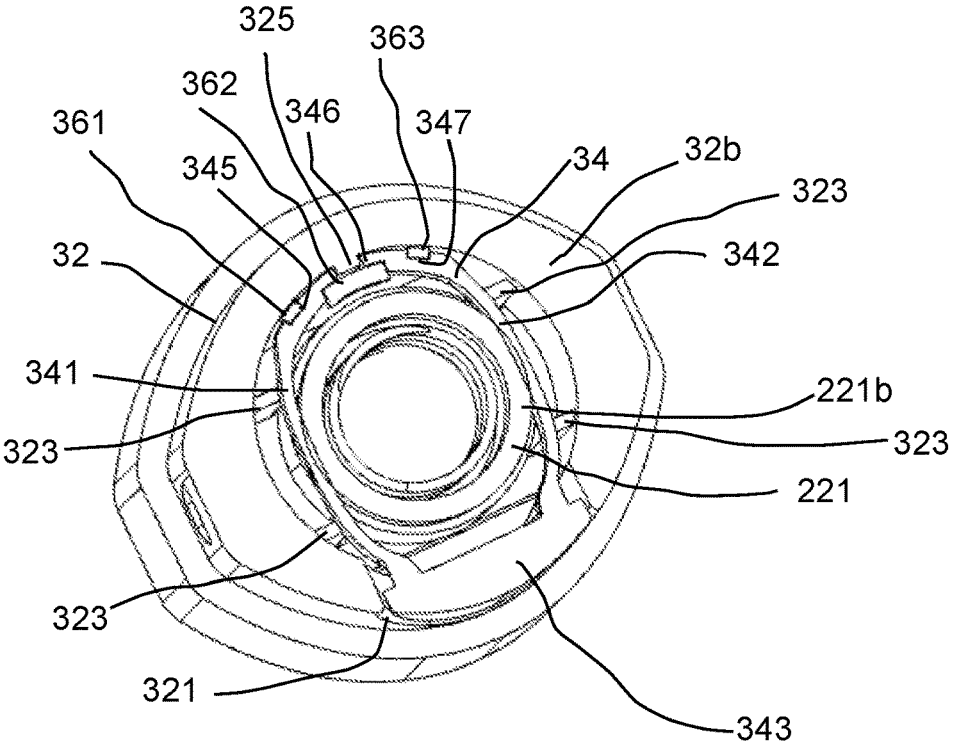
FIG. 13 is a transverse cross sectional view of the refillable container of FIG. 4.

Referring to FIG. 12, a perspective view of the button member 34 is shown, the button member 34 comprises a button portion 343 and a gripping portion. The gripping portion comprises a pair of arcuate portions 341, 342 opposite to each other in a circumferential direction. When assembled to the outer shell 32 of the base assembly 30, the button portion 343 is exposed to an outer side through the aperture 321 formed in the outer shell 32 of the base assembly 30, while the pair of arcuate portions 341, 342 lies within the cavity 33 of the outer shell 32, as shown in FIGS. 8 and 13. The pair of arcuate portions 341, 342 of the button member 34 are elastically deformable. Further, as shown in FIG. 12, a first end of each of the arcuate portions 341, 342 is connected to an inner surface of the button portion 343, while a second end of each of the arcuate portions 341, 342 is a free second end. The free second end of each of the arcuate portions 341, 342 faces each other and a circumferential gap 344 exists between the free second ends of the arcuate portions 341, 342. The pair of arcuate portions 341, 342 of the button member 34 is configured to be detachably fitted around the tubular projection 221, more particularly around the conical portion 221*b* of the tubular projection 221 of the inner sleeve 22, see FIG. 14. Further as shown in FIG. 12, the pair of arcuate portions 341, 342 of the button member 34 includes at least three grip grooves 345, 346, 347 near the free second ends of the pair of arcuate portions 341, 342. More particularly, an outer surface of the first arcuate portion 341 includes a first grip groove 345 near its free second end and an outer surface of the second arcuate portion 342 includes a third grip groove 347 near its free second end. A second grip groove 346 is a discontinuous groove which is partially formed on the first arcuate portion 341 and partially on the second arcuate portion 342 on their respective inner surfaces at respective free second end portions, separated by the circumferential gap 344.

Referring back to FIG. 3, the sliding member 38 comprises a top flat wall 38*a* and an annular skirt 38*b* extending downward from a lower surface of the top flat wall 38*a* of the sliding member 38. Further, at least one slide groove 39 is formed in the top flat wall 38*a* of the sliding member 38 at a periphery of the top flat wall 38*a* of the sliding member 38. The sliding member 38 is completely housed in the outer shell 32 of the base assembly 30 and is slidable within the outer shell 32, see FIGS. 9 and 10. The at least one slide groove 39 is configured to accommodate a corresponding slide guide protrusion 323 formed on an inner surface at a lower portion of outer shell 32, refer FIG. 11. In other words, the slide guide protrusion 323 of the outer shell 32 is inserted in the corresponding slide groove 39 of the sliding member 38 to guide the sliding member 38 to slide in an axial direction by a predetermined interval within the outer shell 32 of the base assembly 30.

In exemplary embodiment, the sliding member 38 has four slide grooves 39, see FIG. 3 and the outer shell 32 comprises corresponding four slide guide protrusions 323 (see FIG. 13) so that stability during a sliding movement may be achieved. However, in various embodiments, the number of slide grooves and slide guide protrusions may be more or less than four.

Referring to FIGS. 9-10, the base assembly 30 further houses the spring 40 which is disposed in the outer shell 32 such that it extends between the inner surface of the bottom wall 32*b* of the outer shell 32 and the annular skirt 38*b* of the sliding member 38. The spring 40 in a compressed state biases the sliding member 38 in an upward direction and forces the sliding member 38 to slide upward when the spring 40 expands on release of a compression force on it.

Figure 11:
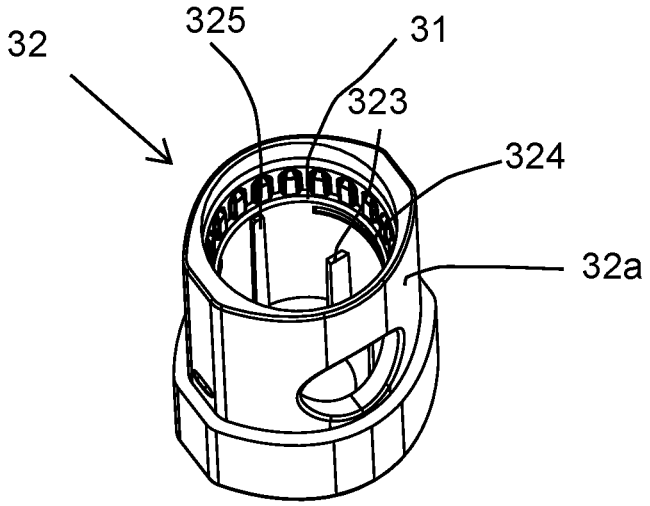
FIG. 11 is a perspective view of an outer shell of the base assembly of FIG. 8.

Referring to FIG. 3, the limiting member 36 of the base assembly 30 is provided inside the outer shell 32 which is coupled to the inner surface of the outer shell 32 at a distal portion thereof, more specifically, the limiting member 36 is coupled to the inner surface of the outer shell 32 that lies immediately below the step 31 in the outer shell 32. As seen in FIGS. 10 and 11, the limiting member 36 includes at least a coupling protrusion 366 (see FIGS. 3 and 15) on an outer surface of the limiting member 36 that snap fits into a corresponding coupling groove 324 of the outer shell 32 to secure the limiting member 36 to the outer shell 32 of the base assembly 30.

Figure 15:
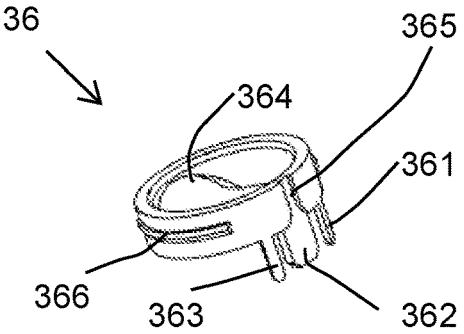
FIG. 15 is a perspective view of a limiting member of the refillable container of FIG. 3.

As shown in FIGS. 3 and 15, the limiting member 36 has an annular ring like structure, and comprises at least three grip projections 361, 362, 363, namely a first grip projection 361, a second grip projection 362 and a third grip projection 363, that extend downwardly from a lower end of the annular ring of the limiting member 36. The limiting member 36 further includes a concave cut out 364 on the outer surface of the limiting member 36 substantially opposite the at least three grip projections 361, 362, 363. A first grip projection 361 and a third grip projection 363 flush with the outer surface of the limiting member 36 while the second grip projection 362 flush with an inner surface of the limiting member 36. The limiting member 36 further includes a positioning groove 365 that extends in axially on the outer surface of the limiting member 36 opposite the second grip projection 362 of the limiting member 36.

Figure 14:
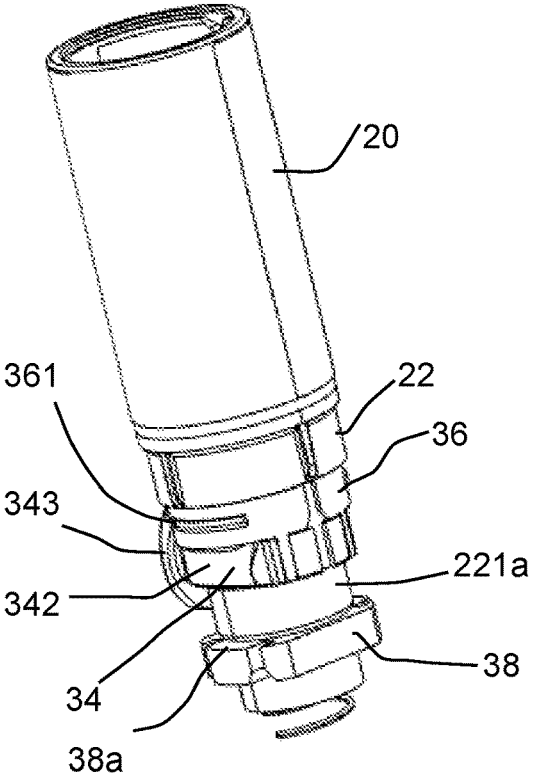
FIG. 14 is a perspective view of the refillable container of FIG. 4 with the outer shell removed.

According to an aspect of the present disclosure, the limiting member 36 functions to hold the button member 34 in an axially fixed position inside the outer shell 32 of the base assembly 30. As shown in FIGS. 9 and 10, the button member 34 is mounted below the limiting member 36 inside the outer shell 32 of the base assembly 30. As shown in FIGS. 13 and 14, the at least three grip grooves 345, 346, 347 of the pair of arcuate portions 341, 342 of button member 34 are configured to receive the corresponding at least three grip projections 361, 362, 363 of the limiting member 36 to couple the button member 34 to the limiting member 36, and wherein at least three grip grooves 345, 346, 347 of the pair of arcuate portions 341, 342 of button member 34 have widths into which at least three grip projections 361, 362, 363 of the limiting member 36 fit. More particularly, the first grip projection 361 and a third grip projection 363 of the limiting member 36 are received respectively in the first grip groove 345 and the third grip groove 347 formed on the outer surface of the arcuate portions 341, 342 of the button member 34. The second grip projection 346 of the limiting member 36 is received in the second grip groove 362 formed partially on the inner surfaces of the arcuate portions 341, 342 of the button member 34. Thus, the button member 34 is firmly gripped by the at least three grip projections 361, 362, 363 of the limiting member 36.

Referring to FIGS. 11 and 13, the inner surface of the sidewall 32*a* of the outer shell 32 of the base assembly 30 comprises a longitudinal positioning rib 325 that extends from the bottom wall 32*b* of the outer shell 32 up to the step 31 of the outer shell 32 along the sidewall 32*a* of the outer shell 32. The positioning longitudinal rib 325 is provided to orient the position of the limiting member 36 within the cavity 33 of the outer shell 32. Thus, the longitudinal positioning rib 325 engages the positioning groove 365 of the limiting member 36 to orient the limiting member 36 such that the grip projections 361, 362, 363 of the limiting member 36 circumferentially opposes the aperture 321 of the outer shell 32 and the concave cutout 364 of the limiting member 36 aligns with the aperture 321 of the outer shell 32. Similarly, the positioning longitudinal rib 325 also orient the button member 34 properly during assembling by engaging between the corresponding gap 344 between the arcuate portions 341, 342 of the button member 34, see FIG. 13.

As shown in FIG. 13, the free second end portions of the arcuate portions 341, 342 of the button member 34 are firmly sandwiched or abut between the second grip projection 362 of the limiting member 36 and the sidewall 32*a* of the outer shell 32 which increases the installation stability of the button member 34 and also ensures that the button member 34 does not shift axially when the button portion 343 is pressed. In other words, the spring 40 bias the sliding member 38 to slide and push the refill cartridge 20 in an upward discharge position so that the refill cartridge 20 is released from the base assembly 30.

According to an aspect of the present disclosure, the lower ends of the at least three grip projections 361, 362, 363 of the limiting member 36 define an upper slide limit for the sliding member 38 as it limits further an upward travel movement of the sliding member 38 by abutting the top flat wall 38*a* of the sliding member 38. The limiting member 36 thus also prevents the sliding member 38 from getting out of the outer shell 32 by abutting against the top flat wall 38*a* of the sliding member 38 when the sliding member 38 slides upward.

Referring to FIGS. 3, 13, and 14, the refill cartridge 20 is inserted into the outer shell 32 of the base assembly 30 preferably through the opening 32*c* of the outer shell 30. On inserting the refill cartridge 20, the tubular projection 221 of the inner sleeve 22 is received in the cavity 33 of the outer shell 32, and wherein the pair of arcuate portions 341, 342 of the button member 34 pass over a cylindrical rim portion 221*a* of the tubular projection 221 of the inner sleeve 22 and engage with the conical portion 221*b* of the tubular projection 221 which is stepped in from the cylindrical rim portion 221*a*, thereby preventing the refill cartridge 20 from being pulled out from grip of the pair of arcuate portions 341, 342 of the button member 34. The button portion 343 of the button member 34 acts as a disengaging means attached with the pair of arcuate portions 341, 342. By pushing in the button portion 343, the pair of arcuate portions 341, 342 disengages from the tubular projection 221 of the inner sleeve 22 because of elastic deformation of the pair of arcuate portions 341, 342. In various embodiments, the button portion 343 and the pair of arcuate portions 341, 342 may or may not be integrally attached.

In a rested state, the pair of arcuate portions 341, 342 form a substantially oval (see FIG. 12) or fusiform cross-section (not shown) with its major axis substantially larger than a diameter of the cylindrical rim portion 221*a* of the tubular projection 221 of the inner sleeve 22 and its minor axis is smaller than the diameter of the cylindrical rim portion 221*a*. When the pair of arcuate portions 341, 342 is elastically deformed by pressing the button portion 343, the pair of arcuate portions 341, 342 deform to attain a substantially circular shape, thus an inner diameter formed by the pair of arcuate portions 341, 342 becomes larger than the diameter of the cylindrical rim portion 221*a* of the tubular projection 221 of the inner sleeve 22.

The pair of arcuate portions 341, 342 and the button portion 343 may be made of a resilient material such as resilient metal or a hard and elastic synthetic resin. The button portion 343 is slidably received in the radial aperture 321 formed in the at least one sidewall 32*a* of the outer shell 32 of the base assembly 30.

In an unstressed state shown in FIGS. 13 and 14, the pair of arcuate portions 341, 342 engages the conical portion 221*b* of the tubular projection 221 of the inner sleeve 22, keeping the refill cartridge 20 from coming off the outer shell 32 of the base assembly 30. When replacing the refill cartridge 20, the button portion 343 is pushed in by pressing, the pair of arcuate portions 341, 342 is compressed from both ends of its major axis and deformed into a substantially circular shape having a larger diameter than the diameter of the cylindrical rim portion 221*a* of the tubular projection 221 of the inner sleeve 22. In this state, the pair of arcuate portions 341, 342 disengages from the conical portion 221*b* of the tubular projection 221 of the inner sleeve 22. In other words, when the button portion 343 is pressed so that the pair of arcuate portions 341, 342 is outwardly expanded and elastically deformed, and the pair of arcuate portions 341, 342 is no longer crimped on the conical portion 221*b* of the tubular projection 221 of the inner sleeve 22. When the button portion 343 is pressed and the refill cartridge 20 is in a normally removable position, the spring 40 expands causing the sliding member 38 to slide and push the refill cartridge 20 to assume an extended position thereby the refill cartridge 20 is forcefully ejected from the outer shell 32 of the base assembly 30. The refill cartridge 20 pops out in a vertical direction providing a visual indication to a user that the refill cartridge 20 is now unlocked from the base assembly 30 and thus the refill cartridge 20 may be easily and quickly removed from the base assembly 30. In other words, the refill cartridge 20 can be removed from the base assembly 30 simply by pushing in the button portion 343 with one finger. Sliding of the sliding member 38 stops in upward direction when it abuts a lower end of the limiting member 36. A new refill cartridge 20 now can be inserted in the base assembly 30. Further, when the finger is released from the button portion 343, the pair of arcuate portions 341, 342 return to their original oval shape by own resiliency restoring to original shapes and are crimped on the conical portion 221*b* of the new refill cartridge 20 again, thereby fixing the new refill cartridge 20.

The components of the base assembly 30, refill cartridge 20 and the cap 10 may be formed of any polymeric material such as acrylonitrile butyrene styrene, metal, wood or any other suitable material.

In various embodiments (not shown), the sliding member 38 and the spring 40 may be made integral.

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variations that fall within the scope of the appended claims.

What is claimed is:

1. A refillable container for a stick type cosmetic product, comprising:

a base assembly;

a cap detachably attached to the base assembly;

a refill cartridge;

wherein the base assembly comprises an outer shell, a limiting member and a button member;

wherein the outer shell of the base assembly includes at least one sidewall, a bottom wall, an opening at a distal end of the outer shell, and defining a cavity therein;

wherein the refill cartridge is configured to be detachably received at least partially within the cavity of the outer shell of the base assembly;

wherein the limiting member is coupled to an inner surface of the outer shell;

wherein the limiting member comprises at least three grip projections that extend downwardly from an annular ring like structure of the limiting member;

wherein the button member comprises a button portion and a pair of arcuate portions;

wherein the pair of arcuate portions is opposite to each other in a circumferential direction, and wherein the pair of arcuate portions each includes a first end connected to the button portion and a free second end;

wherein the button portion is exposed to an outer side through an aperture formed in the at least one sidewall of the outer shell of the base assembly, while the pair of arcuate portions lies within the cavity of the outer shell;

wherein the pair of arcuate portions comprises at least three grip grooves which are configured to receive the corresponding at least three grip projections of the limiting member so as couple the button member to the limiting member;

wherein the pair of arcuate portions of the button member detachably fits around a portion of the refill cartridge to lock the refill cartridge within the base assembly; and wherein when the button portion is pressed, the pair of arcuate portions of the button member elastically deforms to release the refill cartridge from the base assembly.

2. A refillable container for a stick type cosmetic product, comprising:

a base assembly;

a cap detachably attached to the base assembly;

a refill cartridge;

wherein the base assembly comprises an outer shell, a limiting member, a button member, a sliding member and a spring;

wherein the outer shell of the base assembly includes at least one sidewall, a bottom wall, an opening at a distal end of the outer shell, and defining a cavity therein;

wherein the refill cartridge is configured to be detachably received at least partially within the cavity of the outer shell of the base assembly;

wherein the cavity of the outer shell houses the limiting member, the button member, the sliding member and the spring arranged in this order from the distal end to a proximal end of the outer shell;

wherein the limiting member is coupled to an inner surface of the outer shell;

wherein the limiting member comprises at least three grip projections that extend downwardly from an annular ring like structure of the limiting member;

wherein the button member comprises a button portion and a pair of arcuate portions;

wherein the pair of arcuate portions is opposite to each other in a circumferential direction, and wherein the pair of arcuate portions each includes a first end connected to the button portion and a free second end;

wherein the button portion is exposed to an outer side through an aperture formed in the at least one sidewall of the outer shell of the base assembly, while the pair of arcuate portions lies within the cavity of the outer shell;

wherein the pair of arcuate portions comprises at least three grip grooves which are configured to receive the corresponding at least three grip projections of the limiting member so as couple the button member to the limiting member;

wherein the sliding member includes least one slide groove which is configured to engage a corresponding slide guide protrusion formed on the inner surface of the at least one sidewall of the outer shell;

wherein the pair of arcuate portions of the button member detachably fits around a portion of the refill cartridge to lock the refill cartridge within the base assembly;

wherein when the refill cartridge is locked with the base assembly, a lower end of the refill cartridge moves the sliding member downwardly to compress the spring;

wherein when the button portion is pressed, the pair of arcuate portions of the button member elastically deforms to release the refill cartridge from the base assembly; and wherein when the refill cartridge is released from grip of the pair arcuate portions of the button member, the spring biases the sliding member to slide upwardly and push the refill cartridge in a vertical direction towards the opening at the distal end of the outer shell of the base assembly.

3. The refillable container according to claim 2, wherein the sliding member comprises a top flat wall and an annular skirt extending downward from a lower surface of the top flat wall of the sliding member, and wherein the sliding member comprises four sliding grooves formed in the top flat wall of the sliding member and the outer shell comprises corresponding four slide guide protrusions in the outer shell.

4. The refillable container according to claim 2, wherein the refill cartridge includes an inner sleeve, a spiral cam sleeve, a carrier cup and an outer sleeve.

5. The refillable container according to claim 4, wherein the inner sleeve comprises an upper cylindrical portion having a cylindrical sidewall, an open top end, a closed bottom wall, and at least one longitudinal slot in the cylindrical sidewall thereof.

6. The refillable container according to claim 5, wherein a tubular projection extends downwardly from an outer surface of the closed bottom wall of the upper cylindrical portion of the inner sleeve.

7. The refillable container according to claim 6, wherein the tubular projection of the inner sleeve comprises a cylindrical distal portion, a cylindrical rim portion and a conical portion, and wherein the conical portion is stepped in from the cylindrical rim portion and extends between the cylindrical distal portion and the cylindrical rim portion.

8. The refillable container according to claim 5, wherein the spiral cam sleeve surrounds the upper cylindrical portion of the inner sleeve, and is provided with a spiral groove extending throughout a length of the spiral cam sleeve on an inner surface of the spiral cam sleeve.

9. The refillable container according to claim 4, wherein the carrier cup has an actuating pin projecting laterally from an outer surface of the said carrier cup, and wherein the carrier cup is slidably movable inside the inner sleeve, and wherein the actuating pin extends through at least one longitudinal slot of the inner sleeve and engages with a spiral groove of the spiral cam sleeve.

10. The refillable container according to claim 4, wherein the outer sleeve is tightly surrounding the spiral cam sleeve and holding it in radially compressed condition whereby relative turning movement between the outer sleeve and the spiral cam sleeve is prevented.

11. The refillable container according to claim 2, wherein lower ends of the at least three grip projections of the limiting member define an upper slide limit for the sliding member as at least three grip projections limit a further upward movement of the sliding member.

12. The refillable container according to claim 2, wherein the free second end of each of the pair of arcuate portions faces each other and a circumferential gap exists between the free second ends of the pair of arcuate portions.

13. The refillable container according to claim 5, wherein a lower portion of the upper cylindrical sidewall of the inner sleeve comprises a plurality of second ribs which are evenly distributed in a circumferential direction, and a corresponding rotation lock portion comprises a plurality of first ribs is provided on the inner surface of the at least one sidewall of the outer shell, and wherein the plurality of first ribs of the outer shell engages with the plurality of second ribs of the inner sleeve to prevent the inner sleeve from rotation relative to the outer shell of the base assembly.

14. The refillable container according to claim 13, wherein the inner surface of the at least one sidewall of the outer shell comprises an inner step near a distal end portion of the outer shell, and wherein the plurality of first ribs of the rotation lock portion is evenly distributed in a circumferential direction on the inner surface of the at least one sidewall of the outer shell above the inner step.

15. The refillable container according to claim 14, wherein the outer shell of the base assembly is configured to receive the tubular projection of the inner sleeve of the refill cartridge within the cavity of the outer shell below the inner step of the outer shell, while the upper cylindrical portion of the inner sleeve is received within the cavity of the outer shell above the inner step such that the bottom wall of the upper cylindrical portion of the inner sleeve rests on the inner step of the outer shell.

16. The refillable container according to claim 7, wherein the pair of arcuate portions of the button member is configured to be detachably fitted around the conical portion of the tubular projection of the inner sleeve, and wherein the pair of arcuate portions has an oval shape with its major axis larger than a diameter of the cylindrical rim portion of the tubular projection of the inner sleeve and its minor axis is smaller than the diameter of the cylindrical rim portion so that the pair of arcuate portions is able to lock the refillable cartridge, and wherein when the pair of arcuate portions is elastically deformed by pressing the button portion, an inner diameter formed by the pair of arcuate portions becomes larger than the diameter of the cylindrical rim portion of the tubular projection of the inner sleeve to release the refill cartridge.

17. The refillable container according to claim 2, wherein the pair of arcuate portions of the button member includes a first arcuate portion and a second arcuate portion; wherein the at least three grip grooves include a first grip groove formed on an outer surface of the first arcuate portion near its free second end, a third grip groove formed on an outer surface of the second arcuate portion near its free second end, and a second grip groove which is partially formed on the first arcuate portion and partially on the second arcuate portion on their respective inner surfaces near respective free second ends; and wherein at least three grip projections of the limiting member comprises a first grip projection, a second grip projection and a third grip projection, that extend downwardly from a lower end of the limiting member.

18. The refillable container according to claim 17, wherein the first grip projection and the third grip projection flush with an outer surface of the limiting member while the second grip projection flush with an inner surface of the limiting member, wherein the first grip projection and a third grip projection of the limiting member are received respectively in the first grip groove and the third grip groove formed on the respective first arcuate portion and the second arcuate portion of the button member, and the second grip projection of the limiting member is received in the second grip groove which is formed partially on the first arcuate portion and partially on the second arcuate portion of the button member such that the free second end of each of the pair of arcuate portions are sandwiched between the second grip projection of the limiting member and the at least one sidewall of the outer shell.

19. A refillable container for a stick type cosmetic product, comprising:

a base assembly;

a cap detachably attached to the base assembly;

a refill cartridge;

wherein the base assembly comprises an outer shell, a limiting member, a button member, a sliding member and a spring;

wherein the outer shell of the base assembly includes at least one sidewall, a bottom wall, an opening at a distal end of the outer shell, and defining a cavity therein;

wherein the refill cartridge is configured to be detachably received at least partially within the cavity of the outer shell of the base assembly;

wherein the cavity of the outer shell houses the limiting member, the button member, the sliding member and the spring;

wherein the limiting member is coupled to an inner surface of the outer shell;

wherein the limiting member comprises at least three grip projections that extend downwardly from an annular ring like structure of the limiting member;

wherein the button member comprises a button portion and a pair of arcuate portions opposite to each other in a circumferential direction, wherein the pair of arcuate portions each includes a first end connected to the button portion and a free second end;

wherein the button portion is exposed to an outer side through an aperture formed in the at least one sidewall of the outer shell of the base assembly, while the pair of arcuate portions lies within the cavity of the outer shell;

wherein the pair of arcuate portions comprises at least three grip grooves which are configured to receive the corresponding at least three grip projections of the limiting member so as couple the button member to the limiting member;

wherein the sliding member includes least one slide groove which is configured to engage a corresponding slide guide protrusion formed on the inner surface of the at least one sidewall of the outer shell;

wherein the limiting member includes a positioning groove that extends axially on the outer surface of the limiting member;

wherein a concave cutout formed on the outer surface of the limiting member substantially opposite the at least three grip projections in a circumferential direction;

wherein the inner surface of the at least one sidewall of the outer shell of the base assembly comprises a longitudinal positioning rib which is configured to engage in the positioning groove of the limiting member to orient the limiting member such that the at least three grip projections of the limiting member circumferentially opposes the aperture of the outer shell and the concave cutout of the limiting member aligns with the aperture of the outer shell;

wherein the pair of arcuate portions of the button member detachably fits around a portion of the refill cartridge to lock the refill cartridge within the base assembly;

wherein when the button portion is pressed, the pair of arcuate portions of the button member deforms to release the refill cartridge from the base assembly; and wherein when the refill cartridge is released from grip of the pair arcuate portions of the button member, the spring biases the sliding member to slide upwardly and push the refill cartridge in a vertical direction towards the opening at the distal end of the outer shell of the base assembly.

20. The refillable container according to claim 19, wherein the positioning longitudinal rib is configured to orient the button member by engaging within a gap provided between the free second ends of the pair of arcuate portions of the button member.

* * * * *